US005358655A

United States Patent [19]

Kruse et al.

[11] Patent Number: 5,358,655

[45] Date of Patent: Oct. 25, 1994

[54] PROCESS FOR THE PRODUCTION OF DETERGENT TABLETS FOR DISHWASHING MACHINES

[75] Inventors: Hans Kruse; Christiane Zeise, both of Korschenbroich; Jochen Jacobs, Wuppertal; Juergen Haerer, Duesseldorf, all of Fed. Rep. of Germany

[73] Assignee: Henkel Kommanditgesellschaft auf Aktien, Fed. Rep. of Germany

[21] Appl. No.: 137,106

[22] PCT Filed: Apr. 3, 1992

[86] PCT No.: PCT/EP92/00744

§ 371 Date: Oct. 12, 1993

§ 102(e) Date: Oct. 12, 1993

[87] PCT Pub. No.: WO92/18604

PCT Pub. Date: Oct. 29, 1992

[30] Foreign Application Priority Data

Apr. 12, 1991 [DE] Fed. Rep. of Germany ..... 4112075

[51] Int. Cl.[5] ..... C11D 3/60; C11D 11/00; C11D 11/02; C11D 17/00

[52] U.S. Cl. ..... 252/95; 252/99; 252/102; 252/174; 252/174.14; 252/174.19; 252/174.21; 252/174.24; 252/DIG. 16

[58] Field of Search ..... 252/95, 99, 102, 135, 252/174, 174.14, 174.19, 174.21, 174.24, DIG. 16

[56] References Cited

U.S. PATENT DOCUMENTS

| | | | |
|---|---|---|---|
| 3,366,570 | 1/1968 | Slob | 252/99 |
| 3,423,322 | 1/1969 | Cooper | 252/135 |
| 4,370,250 | 1/1983 | Joshi | 252/135 |
| 4,828,745 | 5/1989 | Jeschke | 252/99 |
| 4,828,749 | 5/1989 | Kruse | 252/135 |
| 4,839,078 | 6/1989 | Kruse et al. | 252/99 |
| 4,897,212 | 1/1990 | Kruse et al. | 252/99 |
| 4,913,832 | 5/1990 | Kruse | 252/99 |

FOREIGN PATENT DOCUMENTS

| | | |
|---|---|---|
| 0000076 | 12/1978 | European Pat. Off. . |
| 0025551 | 9/1980 | European Pat. Off. . |
| 0224129 | 6/1987 | European Pat. Off. . |
| 0264701 | 4/1988 | European Pat. Off. . |
| 0355626 | 2/1990 | European Pat. Off. . |
| 0395333 | 10/1990 | European Pat. Off. . |
| 0432437 | 6/1991 | European Pat. Off. . |
| 3541145 | 5/1987 | Fed. Rep. of Germany . |
| 3937469 | 11/1989 | Fed. Rep. of Germany . |
| 4010524 | 9/1990 | Fed. Rep. of Germany . |
| 9115568 | 10/1991 | PCT Int'l Appl. . |

OTHER PUBLICATIONS

Methode: vergleiche Ritschel. Die Tablette, Ed. Cantor, 1966, p. 313.

*Primary Examiner*—Dennis Albrecht
*Attorney, Agent, or Firm*—Ernest G. Szoke; Wayne C. Jaeschke; Real J. Grandmaison

[57] ABSTRACT

A process for producing stable, bifunctional, phosphate- and metasilicate-free, low-alkali detergent tablets useful for dishwashing machines from granulated detergent additives consisting of sodium salts of at least one homopolymeric or copolymeric (meth)acrylic acid, comprising agglomerating the granulated detergent additives with builders and water to form an agglomerate, treating the agglomerate with hot air in a fluidized bed, mixing the agglomerate with a bleaching agent, and tabletting the mixture.

7 Claims, No Drawings

PROCESS FOR THE PRODUCTION OF DETERGENT TABLETS FOR DISHWASHING MACHINES

BACKGROUND OF THE INVENTION

1. Field of the Invention

Machine dishwashing generally consists of a prerinse cycle, a main wash cycle, one or more intermediate rinse cycles, a final rinse cycle and a drying cycle. This applies both to domestic and to institutional dishwashing machines.

Hitherto, it has mainly been standard practice in the case of domestic dishwashing machines, hereinafter referred to as DDWM, to place the detergent in a dispensing box which is generally located in the door of the machine and which automatically opens at the beginning of the main wash cycle. The preceding prerinse cycle is completed without any active substance, i.e. solely with the cold inflowing tapwater.

In institutional dishwashing machines, hereinafter referred to as IDWM, the so-called precleaning zone corresponds in principle to the prerinse cycle of a DDWM. In dishwashing machines for large kitchens, the detergent added to the main wash zone carries over into the precleaning zone where it is used to support the removal of adhering food remains. Although there are IDWM where the precleaning zone is only fed with fresh water, a precleaning zone where detergent is added is more effective than precleaning with freshwater alone.

The principle by which the precleaning zone operates in IDWM has already been applied to DDWM, enabling detergents to be added during the prerinse cycle by introduction in tablet form and positioning of one or more suitable tablets, for example, in an unoccupied part of the cutlery basket or even elsewhere in the machine, so that they could act both during the prerinse cycle and in the actual wash cycle, i.e. could perform a dual function.

2. Discussion of Related Art

The use of such detergent tablets is described, for example, in DE 35 41 145 A1. The tablets in question are detergent tablets of uniform composition with a broad dissolving profile for machine dishwashing which contain typical alkaline-reacting components, more particularly from the group of alkali metal metasilicates and pentaalkali metal triphosphates, active chlorine compounds and tabletting aids, and in which the alkali metal metasilicates consist of a mixture of "sodium metasilicate nonahydrate" ($Na_2H_2SiO_4.8H_2O$) and anhydrous sodium metasilicate while the pentaalkali metal triphosphate consists of anhydrous pentasodium triphosphate, the ratio by weight of anhydrous sodium metasilicate to sodium metasilicate nonahydrate being 1:0.3 to 1:1.5 and the ratio by weight of pentasodium triphosphate to sodium metasilicate—both anhydrous—being from 2:1 to 1:2 and preferably from 1:1 to 1:1.7.

Tablets such as these have such a broad dissolving profile that, even in the prerinse cycle of a DDWM, at least 10% by weight of the tablets can be dissolved by the cold inflowing tapwater, a pH value of at least 10.0 being developed in the wash liquor. Given high solubility in warm water, at least 60% by weight and preferably at least 70% by weight of the tablets are still available for the main wash cycle.

In the context of the invention, the dissolving profile is understood to be the ratio by weight of parts of the tablet dissolved under the conditions of the prerinse cycle of typical DDWM to the tablet as a whole.

However, known tablets contain phosphates which are known to be undesirable.

However, there are also commercially available phosphate-free detergent tablets for dishwashing machines (for example Hui Spül-Tabs, a product of Roth GmbH, Bad Ems) which essentially contain silicates, nonionic surfactants, organic complexing agents and percarbonate. However, when these tablets are placed in the machine (for example in the cutlery basket), they dissolve completely or substantially completely during the actual prerinse cycle, so that hardly any more detergent is available for the main wash cycle. In addition, the stability of these tablets is unsatisfactory.

DE 40 10 524 A1 describes stable, dual-function phosphate-free detergent tablets for dishwashing machines containing silicate, low-foaming nonionic surfactants, organic complexing agents, bleaching agents and water and, in addition, organic complexing agents according to DE 39 37 469 A1 in the form of a granular alkaline detergent additive consisting of sodium salts of at least one homopolymeric or copolymeric (meth)acrylic acid, sodium carbonate, sodium sulfate and water. In the production of these tablets, the granular alkaline additives are mechanically mixed with the other generally powder-form constituents and the resulting mixture is tabletted in known manner.

Now, the problem addressed by the present invention was to follow a market trend by providing a stable, dual-function, phosphate- and metasilicate-free low-alkaline detergent tablet with a broad dissolving profile for dishwashing machines, at least 10% by weight to about 40% by weight of which is dissolved by the cold tapwater flowing into the prerinse cycle of a DDWM, which develops a pH value of at most about 10.5 in the wash liquor and of which at least 60% by weight to around 90% by weight is still available for the main wash cycle by virtue of the high solubility in the tablet in warm water.

The known detergent tablets were produced by the tabletting of powder mixtures containing anhydrous sodium metasilicate in addition to sodium metasilicate nonahydrate containing water of hydration. This combination of water-containing substances and substances capable of absorbing water led to an increase in the resistance of the tablets to breakage in storage. Since the tablets according to the invention cannot contain any of the raw materials mentioned above in view of the low alkalinity required, they are not sufficiently resistant to breakage after tabletting in accordance with the prior art from powder mixtures or from powder mixtures with a granular component.

DESCRIPTION OF THE INVENTION

It has now been found that stable, dual-function, phosphate- and metasilicate-free, low-alkaline detergent tablets for dishwashing machines containing granular, alkaline detergent additives according to DE 39 37 469 A1, builders, bleaching agents, water and optionally low-foaming nonionic surfactants, enzymes, bleach activators, perfumes and/or dyes can be obtained if the granular alkaline detergent additives are resubjected to agglomerating granulation in known manner together with the builders, water and nonionic surfactant, if any, the granules formed are subsequently aftertreated with hot air in a fluidized bed and then mixed with the bleaching agent and optionally with a bleach activator, fragrance, enzymes and/or dye and the mixture obtained is tabletted in a standard tabletting press. The tablets produced in accordance with the invention have a high breakage resistance (greater than 140N for a diameter of 35 to 40 mm and a density of approximately 1.6 to 1.8 g/cm$^3$) which they retain during storage and which can even increase significantly in a short time. When put to their intended use, the tablets dissolve with a broad dissolving profile.

The detergent additive, its production and its use in dishwashing machines are the subject of hitherto unpublished DE 39 37 469 A1. The use of the additive in tablets is not mentioned in this document. It consists of (a) 35 to 60% by weight sodium salts of at least one homopolymeric or copolymeric (meth)acrylic acid,
(b) 25 to 50% by weight sodium carbonate (anhydrous),
(c) 4 to 20% by weight sodium sulfate (anhydrous) and
(d) 1 to 7% by weight water, preferably
(a) 40 to 55% by weight and, more particularly, 45 to 52% by weight,
(b) 30 to 45% by weight and, more particularly, 40 to 40% by weight,
(c) 5 to 15% by weight and, more particularly, 5 to 10% by weight and
(d) 2 to 6% by weight and, more particularly, 3 to 5% by weight of the compounds mentioned.

Component (a) consists of homopolymeric or copolymeric carboxylic acids in the form of the sodium salts. Suitable homopolymers are polymethacrylic acid and, preferably, polyacrylic acid, for example those having a molecular weight in the range from 800 to 150,000 (based on acid). If polyacrylic acids (in salt form) only are used, their molecular weight in the interests of free flow and stability in storage is preferably in the range from 1,000 to 80,000 (based on acid).

Suitable copolymers are those of acrylic acid with methacrylic acid and, preferably, copolymers of acrylic acid or methacrylic acid with maleic acid. The copolymers of acrylic acid with maleic acid which are characterized, for example, in EP 25 551 81 have proved to be particularly suitable. The copolymers in question are copolymers containing 50 to 90% by weight acrylic acid and 50 to 10% by weight maleic acid. Copolymers in which 60 to 85% by weight acrylic acid and 40 to 15% by weight maleic acid are present are particularly preferred. Their molecular weight, based on free acids, is generally in the range from 5,000 to 200,000 and preferably in the range from 10,000 to 120,000.

Mixtures of various homopolymers and copolymers, more particularly mixtures of homopolymeric acrylic acid and the above-described copolymers of 50 to 90% by weight acrylic acid and 50 to 10% by weight maleic acid, may also be used with advantage. Mixtures such as these, which are distinguished by favorable particle properties and high stability in storage, may consist for example of 10 to 50% by weight homopolymeric acrylic acid and 90 to 50% by weight acrylic acid/maleic acid copolymers. These mixtures may also include homopolymeric polyacrylic acids which, when used on their own, show a slightly greater tendency towards agglomeration or coalescence of the particles than low molecular weight polyacrylates.

The sodium carbonate (b) and the sodium sulfate (c) are used in anhydrous form. With sodium carbonate contents of approximately 40% by weight and more, it is advisable to reduce the water content (d) of the additives to less than 6% by weight or slightly to increase the sodium sulfate content, for example to between 8 and 15% by weight. Sodium sulfate contents of more than 10% by weight and preferably from 15 to 20% by weight basically improve the particle properties and the stability in storage of the additives. On the other hand, sodium sulfate represents ineffectual ballast where the additives are used so that its content should be as small as possible. It is very surprising that contents of only 5 to 6% by weight (c) are sufficient to stabilize additives containing approximately 50% by weight (a), approximately 40% by weight (b) and approximately 4% by weight (d) and to guarantee good flow properties.

In addition, the detergent additives may contain minor constituents, such as dyes and colored pigments, and may be uniform or speckled in color. The percentage content of the minor constituents is well below 1% by weight.

Suitable builders are sodium citrates, nitrilotriacetate, phosphonates, alkali metal carbonates and alkali metal disilicates. Together with the polycarboxylate-containing detergent additive, they bind hardness salts, such as calcium and magnesium ions, from the water and from food remains by complexing or dispersion and thus prevent the formation of lime coatings on the dishwashing machine and its contents. They may be used as anhydrous salts and/or as hydrate salts. Hydrate salts can even be formed during the agglomerating granulation from approximately 5 to 10 parts by weight and preferably 6 to 8 parts by weight water and salts used in anhydrous form.

The polycarboxylates are used in powder form, but preferably in granular form. Suitable polyacrylates include Alcosperses ®, a product of Alco: Alcosperse ® 102, 104, 106, 404, 406; Acrysols ®, products of Norsohaas: Acrysols ® A 1N, LMW 45 N, LMW 10 N, LMW 20 N, SP 02N; Degapas ®, a product of Degussa: Degapas ® 4104 N; Good-Rite ®, a product of Goodrich: Good-Rite ® K-XP 18. Copolymers (polyacrylic acid and maleic acid) may also be used, for example Sokalans ®, products of BASF: Sokalan ® CP 5, CP 7; Acrysols ®, products of Norsohaas: Acrysol ® QR 1014; Alcosperses ®, a product of Alco: Alcosperse ® 175. The sodium citrate used may be trisodium citrate or trisodium citrate dihydrate. The preferred phosphonate is the tetrasodium salt of 1-hydroxyethane-1,1-diphosphonic acid (Turpinal ® 4 NZ, a product of Henkel KGaA). The alkali metal carbonate used is preferably sodium carbonate of any quality, for example calcined soda, compacted soda or even sodium hydrogen carbonate. A suitable disilicate is dried waterglass with an $SiO_2$ to $Na_2O$ ratio of 1:2–2.5 (for example Portil ® A or AW, products of Henkel KGaA, Britesil ® H 24 or C 24, products of Akzo).

Preferred nonionic surfactants, which are used to promote the separation of fat-containing food remains and as tabletting aids, are extremely low-foaming compounds, preferably $C_{12-18}$ alkyl polyethylene glycol polypropylene glycol ethers containing up to 8 mol ethylene oxide and 8 mol propylene oxide units in the molecule. In general, they make up 0.2 to 5% by weight and preferably 0.5 to 3% of the total weight of the tablets. However, it is also possible to use other nonionic surfactants known as low foamers, such as for example $C_{12-18}$ alkyl polyethylene glycol polybutylene glycol ethers containing up to 8 mol ethylene oxide and 8 mol butylene oxide units in the molecule, in which case 0.2 to 2% by weight and preferably 0.2 to 1% by weight, based on the tablet as a whole, of foam inhibitors such as, for example, silicone oils, mixtures of silicone oil and hydrophobicized silica, paraffin oil/Guerbet alcohols and hydrophobicized silica may optionally be added.

Nowadays, active oxygen carriers as bleaches are typical constituents of detergents for DDWM. Bleaches such as these include above all sodium perborate monohydrate and tetrahydrate and also sodium percarbonate. Since active oxygen on its own only develops it full effect at elevated temperatures, so-called bleach activators are used to activate it at around 60° C., i.e. the temperature of the main wash cycle in DDWM. Preferred bleach activators are TAED (tetraacetylene diamine), PAG (pentaacetyl glucose), DADHT (1,5-diacetyl-2,4-dioxohexahydro-1,3,5-triazine) and ISA (isatoic anhydride).

The separation of protein-containing and starch-containing food remains can be improved by the use of enzymes, such as proteases and amylases, for example proteases, such as BLAP®, a product of Henkel KGaA, Optimase® M-440, Optimase® M-330, Opticlean® M-375, Opticlean® M-250, products of Solvay Enzymes, Maxacal® CX 450,000, Maxapem®, products of Ibis, Savinase® T, a product of Novo, or Esperase® T, a product of Ibis, and amylases, such as Termamyl® 60 T, 90 T, products of Novo, Amylase-LT®, a product of Solvay Enzymes, or Maxamyl® P 5000, a product of Ibis.

The use of tabletting aids, such as mold release agents, for example paraffin oil, is not necessary in the production of the tablets according to the invention and can be omitted providing the tabletting mixtures contain nonionic surfactants which largely perform this function. Typical oxidation-stable dyes and fragrances may also be added to the tabletting mixtures. For aesthetic reasons, the tablets may even be formed in colored layers for otherwise the same composition.

The following ranges may be considered for starting formulations of the detergent tablets produced in accordance with the invention:

| Constituents | Range | Preferred range |
|---|---|---|
| Granular detergent additive | 5–30% | 6–25% |
| Trisodium citrate dihydrate | 5–40% | 9–30% |
| Nitrilotrisodium acetate | 0–25% | 0–20% |
| Sodium phosphonate | 0–10% | 0–5% |
| Sodium carbonate, anhydrous | 5–60% | 10–50% |
| Sodium disilicate | 0–60% | 2–30% |
| Sodium hydrogen carbonate | 0–60% | 0–30% |
| Sodium perborate monohydrate | 3–15% | 5–10% |
| Tetraacetyl ethylene diamine | 0.5–4% | 1–2% |
| Nonionic surfactant | 0–4% | 1–2% |
| Protease | 0.1–1% | 0.2–0.5% |
| Amylase | 0.1–1% | 0.2–0.5% |
| Fragrance | 0–1% | 0.1–0.5% |
| Water | 3–15% | 5–10% |

The average particle size of the granular detergent additives is normally 0.2 to 1.2 mm, the percentage of particles smaller than 0.1 mm in size being no more than 2% by weight and the percentage larger than 2 mm in size being no more than 20% by weight. In a preferred embodiment, at least 80% by weight and, in particular, at least 90% by weight of the particles are between 0.2 and 1.6 mm in size, the percentage of particles between 0.1 and 0.05 mm in size being no more than 3% by weight and, in particular, no more than 1% by weight and the percentage between 1.6 and 2.4 mm in size being no more than 20% by weight and, in particular, no more than 10% by weight. The apparent density is in the range from 350 to 550 g/l.

The granular detergent additives are produced by spray drying of a water-containing slurry. The slurry concentration is between 50 and 68% by weight (non-aqueous component) and preferably between 55 and 60% by weight; the viscosity of the paste is critical and should not exceed 10,000 mPa.s and is advantageously between 2,500 and 6,000 mPa.s. The temperature of the slurry is normally between 50° and 100° C. The pressure at the spray nozzles is generally in the range from 30 to 80 bar and preferably in the range from 40 to 70 bar. The temperature of the drying gases flowing in countercurrent in the entry zone of the spray drying tower, i.e. the so-called ring channel, is advantageously in the range from 200° to 320° C. and, more particularly, in the range from 220° to 300° C. At the tower exit, it should be between 100° and 130° C. and is preferably between 110° and 125° C. Comparatively high operating temperatures such as these are of advantage for the production of a satisfactory product and, despite the high content of inflammable organic material in the spray-dried product, are not critical because the self-ignition temperature is above 330° C. In the interests of favorable particle properties, drying is preferably controlled in such a way that the binding of water is reduced to less than 1 mol $H_2O$ per mol sodium carbonate. Typical spray drying installations (spray drying towers) may be used for the spray drying process, the spray nozzles being arranged in one or more planes.

The spray dried material leaving the tower—optionally after cooling with flowing air—is mixed with the builders, water and optionally nonionic surfactant, resubjected to agglomerating granulation in known manner, mixed with the bleaching agent, optionally a bleach activator, dyes and fragrances and/or enzymes, for example in a Lödige mixer or even in an Imatec, Unimix, Drais or Papenmeier mixer, and then tabletted in conventional tablet presses under pressures of 200 to 1,500 . $10^5$ and preferably under pressures of 300 to 1,000 . $10^5$ Pa. The tabletting process may be carried out in known manner without lubrication in commercial eccentric presses, hydraulic presses or rotary presses. The tabletting mixture does not adhere to the molds. Molds coated with rigid plastic and also uncoated molds gave tablets with smooth surfaces, so that in most cases there was no need to coat the punches with soft plastic.

The tabletting conditions were optimized to establish the desired dissolving profile and, at the same time, adequate tablet hardness. The flexural strength of the tablets may be used as a measure of their hardness (method: cf. Ritschel, Die Tablette, Ed. Cantor, 1966, page 313). Under simulated transport conditions, tablets having a flexural strength of greater than 100N and preferably greater than 150N are classified as sufficiently stable. The flexural strength or breakage resistance of the tablets may be controlled irrespective of their format through the degree of compression, i.e. the tabletting pressure.

Corresponding tablet hardnesses were achieved under the tabletting pressures mentioned above. Differences in solubility could be equalized within limits by varying the tabletting pressure for different compositions.

The specific gravity of the tablets was between 1.2 and 2 g/cm$^3$ and preferably between 1.4 and 1.8 g/cm$^3$. The compression applied during the tabletting process produced changes in density which increased from 0.6 to 1.2 g/cm$^3$ and preferably from 0.8 to 1.0 g/cm$^3$ to 1.2 to 2.0 g/cm$^3$ and preferably to 1.6 to 1.8 g/cm$^3$.

The shape of the tablet can also influence its resistance to breakage and its dissolving rate through the outer surface exposed to the attack of the water. For stability reasons, cylindrical tablets with a diameter-to-height ratio of 0.6 to 4.0:1 were produced.

To measure their resistance to breakage, the tablets were loaded by a wedge. The resistance to breakage corresponds to the weight of the wedge-like load which leads to breakage of the tablet.

The quantities of the mixture to be tabletted for the individual tablets may be varied as required within technically reasonable limits. Depending on the size of the tablets, preferably 1 to 2 or even more tablets are used per machine filling to provide the dishwashing process as a whole with the necessary active substance content of detergent. Tablets weighing 20 to 40 g for a diameter of 35 to 40 mm, which are used one at a time, are preferred. Larger tablets are generally more sensitive to breakage and, in addition, can only be produced at lower rates. With smaller tablets, the handling advantage over granular or powder-form detergents was reduced.

If the remaining constituents of the detergent mixture are individually added to the granular detergent additive, the quality of the tablets obtained was inadequate for retailing because inter alia their resistance to breakage was too low. In addition, the mixtures adhered to the top force of the presses during the tabletting process.

The constituents used in the following Examples are defined by the following legends:

Nonionic surfactants:

Fatty alcohol ethoxylates of BASF:

Plurafac LF 221

Plurafac LF 223: alkyl ($C_{12-18}$) polyethylene glycol (<8 EO) polybutylene glycol (<8 BuO) ether Plurafac LF 403: alkyl ($C_{12-18}$) polyethylene glycol (<8 EO) polypropylene glycol (<8 PO) ether Fatty alcohol ethoxylates of Henkel KGaA: Dehypon LT 104: Fatty alcohol ($C_{12-18}$)*9EO butyl ether Dehypon LS 54: Fatty alcohol ($C_{12-14}$)*5EO*4PO

* = Reacted with phosphonate = Turpinal ® 4 N-Z = tetrasodium salt of 1-hydroxyethane-1,1-diphosphonic acid (Henkel KGaA)
TAED = Tetraacetyl ethylene diamine
NTA = Nitrilotrisodium acetate

EXAMPLES

Example 1

18.7 Parts by weight of a granular alkaline detergent additive consisting of 40.8% by weight anhydrous sodium carbonate, 5.0% by weight sodium sulfate, 50.0% by weight of the sodium salt of the copolymer of maleic acid and acrylic acid, molecular weight 70,000 (Sokalan CP 5, a product of BASF), and 4.2% by weight water, 9.4 parts by weight trisodium citrate . 2 $H_2O$, 18.7 parts by weight sodium disilicate (1:2), 35.0 parts by weight anhydrous compacted sodium carbonate, 0.47 part by weight enzyme (BLAP ®), 1.9 parts by weight $C_{12-18}$ alkyl polyethylene glycol (≦8 EO) polybutylene glycol (≦8 BuO) ether and 7.0 parts by weight water were granulated in a Lödige plouwshare mixer and then aftertreated with hot air in a fluidized bed. The granules obtained had an apparent density of 950 g/l. They were homogeneously mixed with 6.5 parts by weight sodium perborate monohydrate, 1.9 parts by weight tetraacetyl ethylene diamine granules, 0.47 part by weight amylase (Termamyl 60 T ®), 0.47 part by weight protease (BLAP ®) and 0.56 part by weight perfume in a Lödige mixer and the mixture obtained was subsequently converted into tablets in a rotary tabletting press under a pressure of 35 KN. The weight of the tablets was fixed at 35 g. The tablets had a diameter of 38 mm and a height of 18.1 mm. Their density was 1.75 g/cm$^3$. The breaking strength of the tablets was 370N immediately after production and 320N after storage for one week at room temperature and was still 320N after storage for two weeks. 12 to 13 g of the tablet was dissolved in the prerinse cycle. The pH value of a 10% solution of the tablet was 10.4.

Example 2

For comparison, two tablets were produced from powder mixtures of the individual constituents. To this end, the solid raw materials were mixed in a Lödige plowshare mixer while the liquid constituents were added last. Tabletting was carried out in a Korsch EK IV eccentric press.

| Composition | | | |
|---|---|---|---|
| Example | | 2 A | 2 B |
| Detergent additive (granular) | % | 22.0 | 19.87 |
| Tri-Na-citrate × $2H_2O$ | % | 5.0 | 20.00 |
| Sodium disilicate | % | 20.0 | — |
| Sodium carbonate, anhydrous | % | 29.0 | 44.93 |
| Sodium hydrogen carbonate | % | 9.4 | — |
| Sodium perborate × 1 $H_2O$ | % | 7.0 | 7.00 |
| Tetraacetyl ethylene diamine | % | 2.0 | 2.00 |
| Termamyl ® (amylase) | % | 0.5 | 0.50 |
| BLAP ® (protease) | % | 0.5 | 0.50 |
| Plurafac LF 403 | % | 4.0 | 2.00 |
| Perfume | % | 0.6 | 0.20 |

| Tabletting data and tablet properties | | | |
|---|---|---|---|
| Example | | 2 A | 2 B |
| Apparent density of mixture | g/l | 870 | 620 |
| Tablet weight | g | 25 | 25 |
| Tablet diameter | mm | 38 | 38 |
| Tablet density | g/cm$^3$ | 1.57 | 1.39* |
| Tabletting pressure | KN | 13.5 | 25 |
| Breaking strength | | | |
| after production | N | 140 | 90 |
| after 1 week | N | 140 | 82 |
| Dissolution after prerinse cycle | g | Approx. 10 | 10 |

*Higher compression was not possible because part of the tabletting mixture remained on the force of the press.

Tablets were produced as in Example 1 from the following formulations:

| Raw materials | 3 | 4 |
|---|---|---|
| Granular detergent additive | 19.87 | 19.87 |

-continued

| Raw materials | | 3 | 4 |
|---|---|---|---|
| Turpinal 4 NZ | | 2.00 | 2.00 |
| Sodium carbonate, anhydrous | | 45.93 | 45.93 |
| Sodium citrate, anhydrous | | 20.00 | 20.00 |
| Sodium perborate monohydrate | | 7.00 | 7.00 |
| TAED | | 2.00 | 2.00 |
| Termamyl 60 T (protease) | | 0.50 | 0.50 |
| BLAP 140 (amylase) | | 0.50 | 0.50 |
| Plurafac LF 403 | | 2.00 | 2.00 |
| Perfume | | 0.20 | 0.20 |
| Water | | 2.88 | 6.88 |
| Apparent density | (g/l) | 610 | 605 |
| Tablet weight | (g) | 23.8 | 23.8 |
| Tablet height | (mm) | 14.3 | 14.1 |
| Tablet diameter | (mm) | 38 | 38 |
| Tablet density | (g/ml) | 1.46 | 1.49 |
| Hardness immediately after production | (N) | 220 | 285 |
| Hardness after 1 day | (N) | 310 | 341 |
| Hardness after 4 days | (N) | 270 | 390 |

Examples 3 and 4

Tablets of satisfactory breaking hardness, which continued to harden distinctly after storage for 1 day, were obtained by regranulating the raw materials: granular detergent additive, sodium carbonate and Plurafac LF 403 with varying quantities of water. The other raw materials: Turpinal 4NZ, citrate, perborate, TAED, protease, amylase and fragrance, were added to the granules obtained and the whole was then tabletted.

We claim:

1. The process of producing a stable, dual-function, phosphate- and metasilicate-free, low-alkaline detergent tablet for dishwashing machines comprising:

a) agglomerating a homogeneous, spray-dried granular alkaline detergent additive with builders, nonionic surfactants and water to form an agglomerate, said additive comprising (1) 35 to 60% by weight of sodium salts of at least one homopolymeric or copolymeric (meth) acrylic acid, (2) 35 to 50% by weight of anhydrous sodium carbonate, (3) 4 to 20% by weight of anhydrous sodium sulfate, and (4) 1 to 7% by weight of water, all weights being based on the weight of said granular detergent additive, b) treating said agglomerate with hot air in a fluidized bed, c) mixing said agglomerate with a bleaching agent, and d) tabletting said agglomerate and bleaching agent mixture to provide a tablet containing 5 to 30% by weight of said granular detergent additive 5 to 40% by weight of trisodium citrate dihydrate, 5 to 60% by weight of anhydrous sodium carbonate, 3 to 15% by weight of bleaching agent, and 3 to 15% by weight of water, wherein said tablet has a broad dissolving profile whereby at least 10 to 40% by weight of said tablet is dissolved in cold water flowing into a dishwashing machine during the prerinse cycle and at least 60 to 90% by weight of said tablet is available for the main dishwashing cycle.

2. A process according to claim 1 wherein said granular alkaline detergent additives, prior to agglomerating, comprise:

a) at least 80% by weight of particles between 0.2 and 1.6 mm in size, b) up to 3% by weight of particles between 0.1 and 0.05 mm in size, and c) up to 20% by weight of particles between 1.6 and 2.4 mm in size, with a)–c) having an apparent density in the range of 350 to 550 g/l.

3. A process according to claim 2 wherein said particles of a) comprise at least 90% by weight of said granular additives.

4. A process according to claim 2 wherein said particles of b) comprise up to 1% by weight of said granular additives.

5. A process according to claim 1 further comprising adding 0.2 to 5% by weight of a nonionic surfactant to said agglomerate during the agglomerating step of a).

6. A process according to claim 1 further comprising adding a minor amount of at least one additional component selected from a bleach activator, fragrance, enzyme, and dye during the mixing step of c).

7. A process according to claim 5 for producing a stable, bifunctional, phosphate- and metasilicate-free, low alkaline detergent tablet useful for dishwashing machines comprising: agglomerating the granular alkaline detergent additive with 70–95% by weight of builders, said nonionic surfactant and water, said granular additive consisting of a) at least 80% by weight of particles between 0.2 and 1.6 mm in size, b) up to 3% by weight of particles between 0.1 and 0.05 mm in size, c) up to 20% by weight of particles between 1.6 and 2.4 mm in size, with a)–c) having an apparent density in the range of 350 to 550 g/l to form said agglomerate.

* * * * *

UNITED STATES PATENT AND TRADEMARK OFFICE

CERTIFICATE OF CORRECTION

PATENT NO. : 5,358,655

DATED : October 25, 1994

INVENTOR(S) : Kruse et. al.

It is certified that error appears in the above-indentified patent and that said Letters Patent is hereby corrected as shown below:

In claim 1, column 9, line 43, "35", should read:
-- 25 --.

Signed and Sealed this

Twentieth Day of June, 1995

Bruce Lehman

*Attest:*

BRUCE LEHMAN

*Attesting Officer*

*Commissioner of Patents and Trademarks*